US006402272B1

(12) United States Patent
Kuvshinikov

(10) Patent No.: US 6,402,272 B1
(45) Date of Patent: Jun. 11, 2002

(54) ADJUSTABLE PIER WALL SYSTEM

(75) Inventor: Daniel Kuvshinikov, Pasadena, CA (US)

(73) Assignee: Kushwood Manufacturing, Inc., Ontario, CA (US)

( * ) Notice: Subject to any disclaimer, the term of this patent is extended or adjusted under 35 U.S.C. 154(b) by 0 days.

(21) Appl. No.: 09/534,581

(22) Filed: Mar. 27, 2000

(51) Int. Cl.[7] ..... A47B 45/00
(52) U.S. Cl. ..... 312/205
(58) Field of Search ..... 312/205, 7.2, 204, 312/111, 107, 198, 257.1; 52/36.3

(56) References Cited

U.S. PATENT DOCUMENTS 5,303,057 A * 4/1994 Davidow et al. ..... 312/205 X
5,795,041 A * 8/1998 Weaver ..... 312/205
6,283,563 B1 * 9/2001 Lambright et al. ..... 312/208

FOREIGN PATENT DOCUMENTS

DE 3838525 * 3/1990 ..... 312/205

* cited by examiner

*Primary Examiner*—James O. Hansen
(74) *Attorney, Agent, or Firm*—G. Donald Webber, Jr.

(57) ABSTRACT

A pier-type wall system with a pair of piers or upright furniture cabinets or the like movably coupled to a bridge mechanism whereby the piers can be moved relative to each other while maintaining an appearance of structural and ornamental continuity between the piers and the bridge mechanism.

16 Claims, 4 Drawing Sheets

ADJUSTABLE PIER WALL SYSTEM

BACKGROUND

1. Field of the Invention

This invention is directed to a furniture component, in general, and an adjustable furniture component which retains a desired ornamental appearance in particular.

2. Prior Art

There are many types of furniture known and manufactured throughout the world. Certain types of furniture are referred to as piers. These are, generally, upright pieces of furniture in the form of cabinets, book cases or the like. Often two of more of these piers are joined together to form a so-called entertainment center. In these types of furniture, a mid-portion of the unit is open to receive a television set or the like.

However television sets, or other components to be mounted or arranged in the mid-portion of the furniture unit come in many sizes. With a pair of upright piers joined together by a fixed bridge, the mid-portion is fixed in size and configuration. Thus, the size of the component to be installed therein is also fixed and limited.

Likewise, with a fixed furniture unit, the dimensions thereof are fully determined. Thus, the positioning of such a fixed unit is limited to a particular place of location in a dwelling place. This fact limits the decorative flexibility of such a unit which is, typically, fairly expensive. Consequently, with these shortcomings, it is desirable to have an adjustable unit which maintains the beauty and style of a fixed unit.

DESCRIPTION OF A PREFERRED EMBODIMENT

Figure 2:
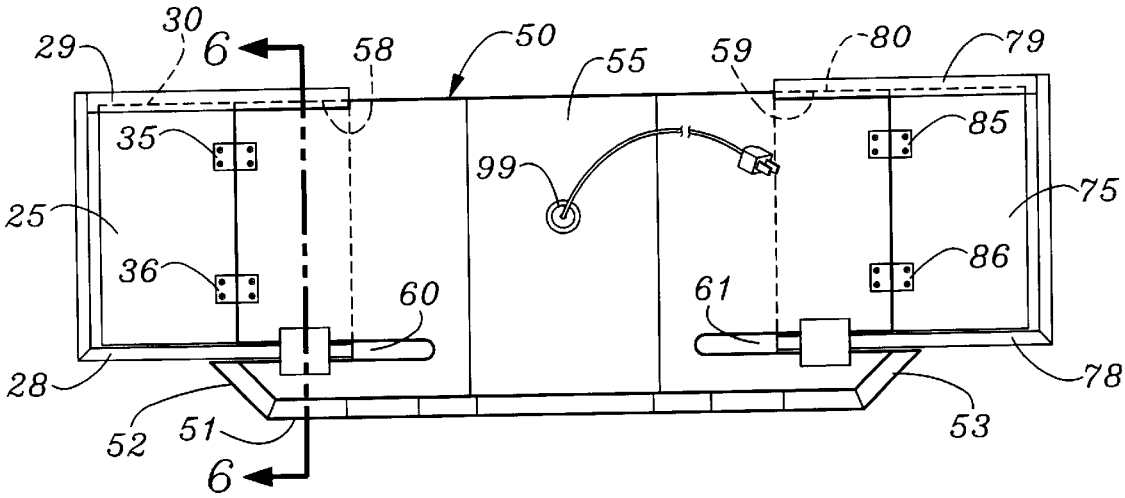
FIG. 2 is a top plan view of the system as shown in FIG. 1.

In the following description, common components bear common reference numerals for convenience.

Figure 1:
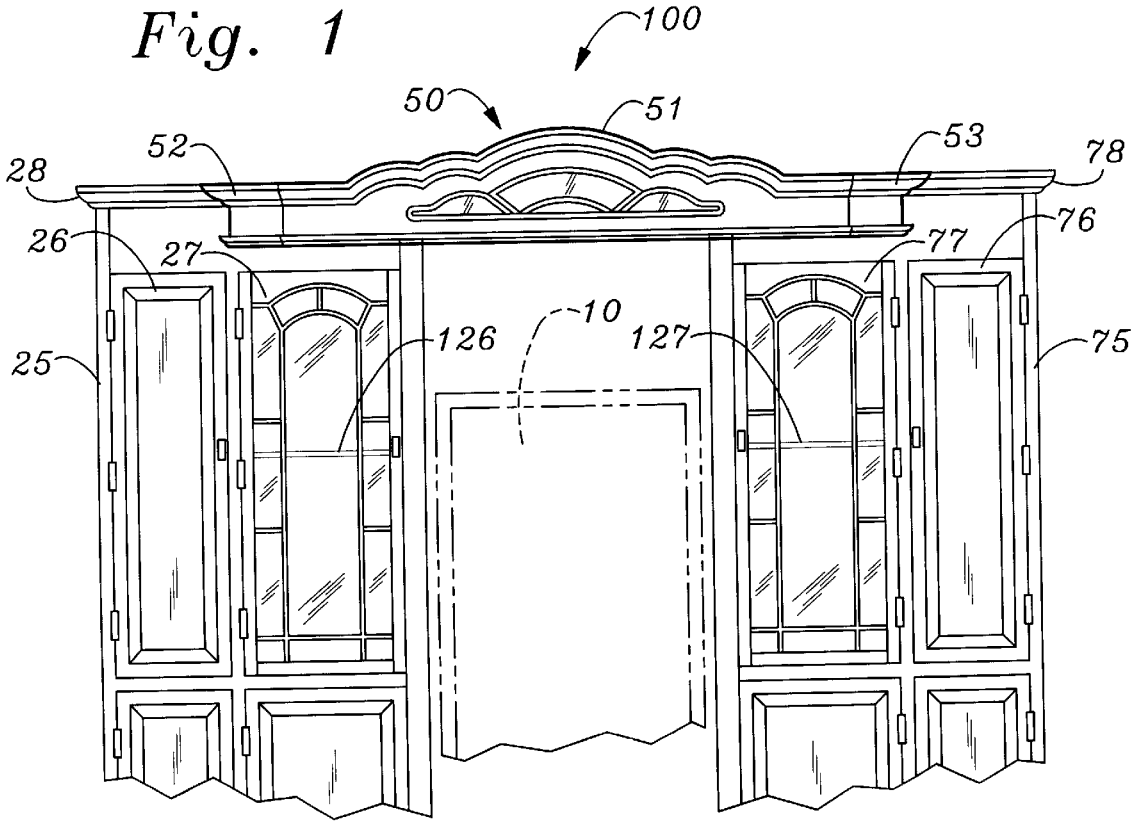
FIG. 1 is a front elevation view of one embodiment of the furniture system of the instant invention in the fully extended position.

Referring now to FIG. 1 there is shown a front elevation view of the expandable furniture or wall system 100 of the instant invention. In this arrangement, the system 100 is fully (or to the extent required) extended in order to receive a large screen television unit 10 (or the like) between the upright piers 25 and 75, respectively. The unit 10 is not a part of the invention per se.

In this embodiment, the piers 25 and 75 are substantially similar in construction in terms of furniture style. That is, the piers 25 and 75 each include glass doors 26 and 27 or 76 and 77, respectively. Of course, the glass doors, per se, can be omitted and shelves 126 or 176, doors or other configurations of cabinetry can be utilized as deemed necessary and/or desirable. The specific details of the piers are not essential and/or limitative of the invention.

However, for esthetic purposes, the piers 25 and 75 are typically coordinated to each other In addition, for convenience, each of the piers may be mounted on wheels, rollers or sliders, not shown.

The bridge 50 includes, typically a decorative facia or crown which is fabricated of a suitably attractive trim piece 51. The trim piece 51, typically, extends outwardly from the faces of the piers 25 and 75, respectively. The facia includes a pair of side returns 52 and 53 which in the preferred embodiment, are angled toward the pier faces. The side returns 52 and 53 are integrally formed with the trim piece 51 in order to provide a unitary component.

The interior ends of the side returns 52 and 53 are carefully formed and arranged so as to carefully fit and conform to the top trim of the piers 25 and 75. Thus, the fascia trim of the bridge 50 is adapted to give the appearance of continuity in trim from the opposite ends of the system 100 irrespective of the relative positions of piers 25 and 75.

Referring now to FIG. 2 there is shown a top plan view of the system 100 including the piers 25 and 75 as well as the bridge 50. The bridge 50 includes the main support plate 55, and the trim fascia 51, as well as the side returns 52 and 53.

In this embodiment, the support plate 55 is multilevel in order to accommodate the optional light fixture 99 However, this construction is not essential to or required for, the practice of the wall system 100 of the instant invention.

The support plate 55 includes a pair of opposed slots 60 and 61 adjacent to the front outer edges of plate 55 and which extend toward the center of the support plate. The length or extent of the slots 60 and 61 is a function of the distance which the piers 25 and 75 move relative to each other and the distance therebetween. The width of the slots 60 and 61 is chosen to slidably engage the top edge portions 28 and 78 of the piers 25 and 75, respectively. This arrangement is shown in greater detail infra.

In conjunction with this slidable arrangement, the tops of the backs 29 and 79 of the piers 25 and 75, respectively, include slots 30 and 80, respectively, to slidably engage and retain the rear edges 58 and 59 of the bridge 50. Thus, the piers 25 and 75 are able to freely move relative to the bridge 50 wherein the space between the facing sides of the piers can define a desired opening therebetween. The defined opening can be nil (when the piers are in abutment) or it can be a relatively large space as defined by the length of bridge 50.

In a preferred embodiment, securing devices such as brackets 35 and 36 are provided relative to the bridge 55 and pier 25. Similarly, brackets 85 and 86 are provided relative to the bridge 55 and pier 75. In a typical application, the brackets are attached to the respective ends of the bridge 55 by appropriate screws or the like.

The brackets are then attached to the top surfaces of the respective piers by appropriate screws or the like. This attachment can be made after both of the piers have been positioned relative to the bridge. Conversely, the brackets at one end of the bridge e.g. brackets 35 and 36 can be attached to pier 25 and, after adjustment of the piers relative to each other, the brackets 85 and 86 can be attached to pier 75. (The opposite sequence is also contemplated, of course.)

Moreover, it should be clear that the number of brackets is not limited to two at each end of the bridge. The number of brackets may be reduced to one or expanded to three or more. Likewise, the size of the brackets can be chosen as desired.

Referring now to FIG. 3 there is again shown a front elevation view of the expandable furniture or wall system 100 of the instant invention. In this arrangement the system 100 is fully closed in order to give the appearance of a unitary wall unit. In this case there is no space (or component) between the upright piers 25 and 75 respectively. It must be understood that any arrangement, i.e., space of the piers intermediate spatial relationships of FIGS. 1 and 3 is permissible.

Figure 3:
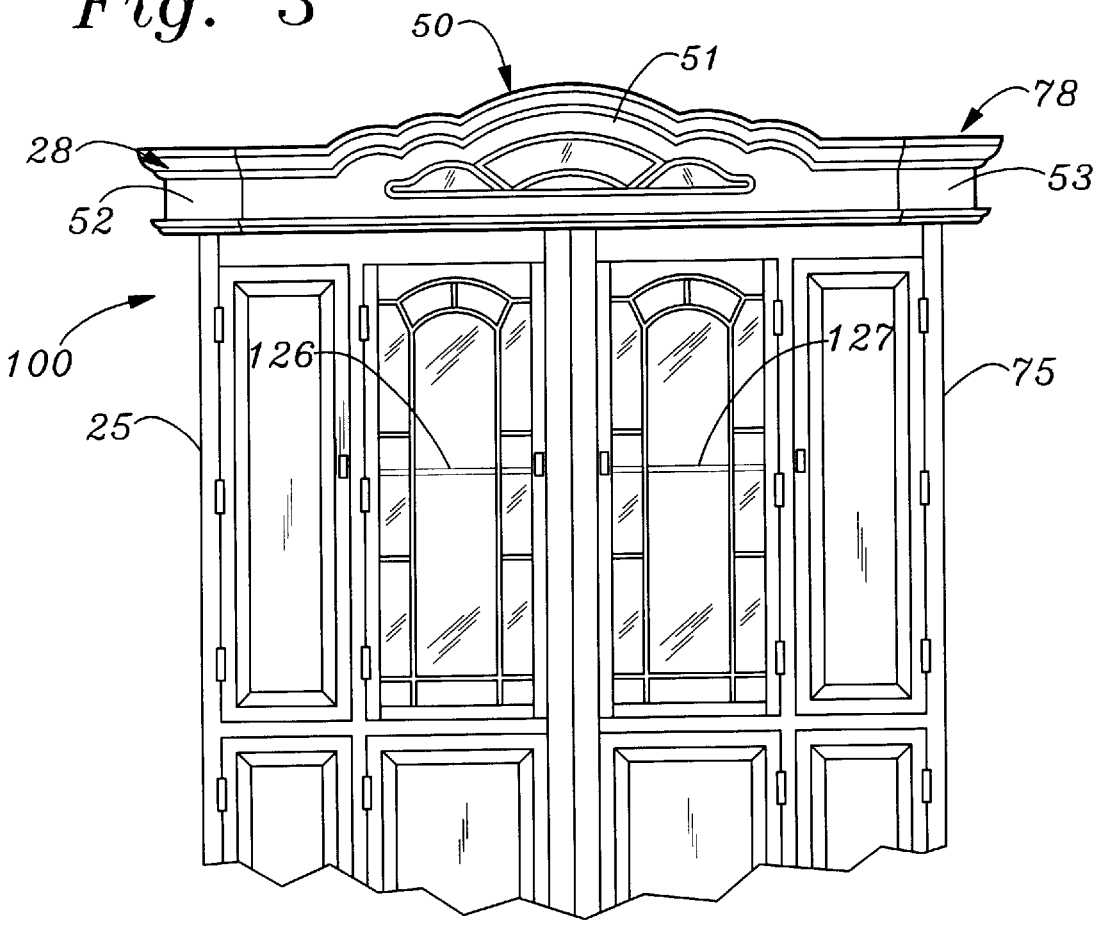
FIG. 3 is a front elevation view of the furniture system shown in FIG. 1 in the closed position.

In FIG. 3, the piers 25 and 75 are again, substantially similar in construction in terms of furniture style. That is, the piers 25 and 75 each include glass doors 26, 27, 76, 77, and shelves 126, 176 or other configurations as deemed necessary and/or desirable. As noted supra, the specific details of the piers is not essential and/or limitative of the invention.

The bridge 50 includes the decorative fascia fabricated of trim piece 51. The trim piece 51 typically, extends outwardly from the faces of the piers 25 and 75, respectively The fascia includes a pair of side returns 52 and 53 which, in the preferred embodiment are angled toward the pier faces. The side returns 52 and 53 are integrally formed with the trim piece 51 in order to provide a unitary component.

The Interior ends of the side returns 52 and 53 are carefully formed and arranged so as to carefully fit and conform to the top trim of the piers 25 and 75. Thus, the fascia trim of the bridge 50 is adapted to give the appearance of continuity in trim from the opposite ends of the system 100.

Figure 4:
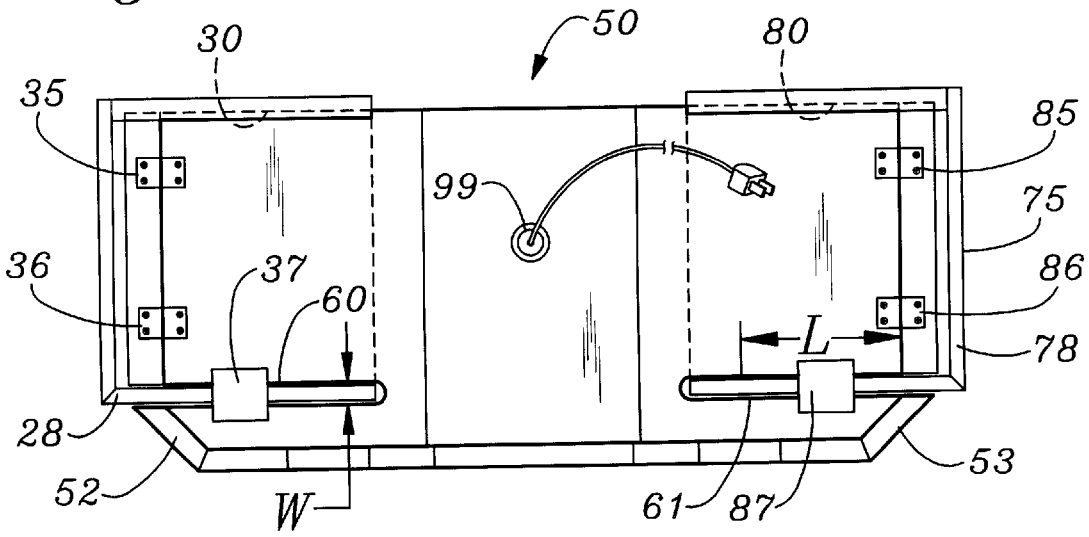
FIG. 4 is a top plan view of the system a shown in FIG. 3.

Referring now to FIG. 4 there is shown a top plan view of the system 100 including the piers 25 and 75 as well as the bridge 50 in the closed position. The bridge 50 includes the main support plate 55, the trim fascia 51, the side returns 52 and 53 and the optional light fixture 99.

The support plate 55 includes the opposed slots 60 and 61 adjacent to the front outer edges of plate 55. The length (L) of the slots is a function of the distance which the piers 25 and 75 move relative to each other and the distance therebetween especially so that the piers can be placed side-by-side in the closed position. The width (W) of the slots 60 and 61 is chosen to slidably engage the tops 28 and 78 of the piers 25 and 75, respectively.

In FIG. 4 the top of the back 29 and 79 of the piers 25 and 75, respectively include slots 30 and 80, respectively, to slidably engage and retain the rear edges 58 and 59 of the bridge 50. Thus, the piers 25 and 75 are able to freely move relative to the bridge 50 wherein the space between the facing sides of the piers can define a desired opening therebetween. The defined opening can be nil (when the piers are in abutment) or it can be a relatively large space as defined by the length of bridge 50. While shown for continuity, the brackets 35, 36, 85 and/or 86 could be removed when the unit is in this configuration.

Figure 5:
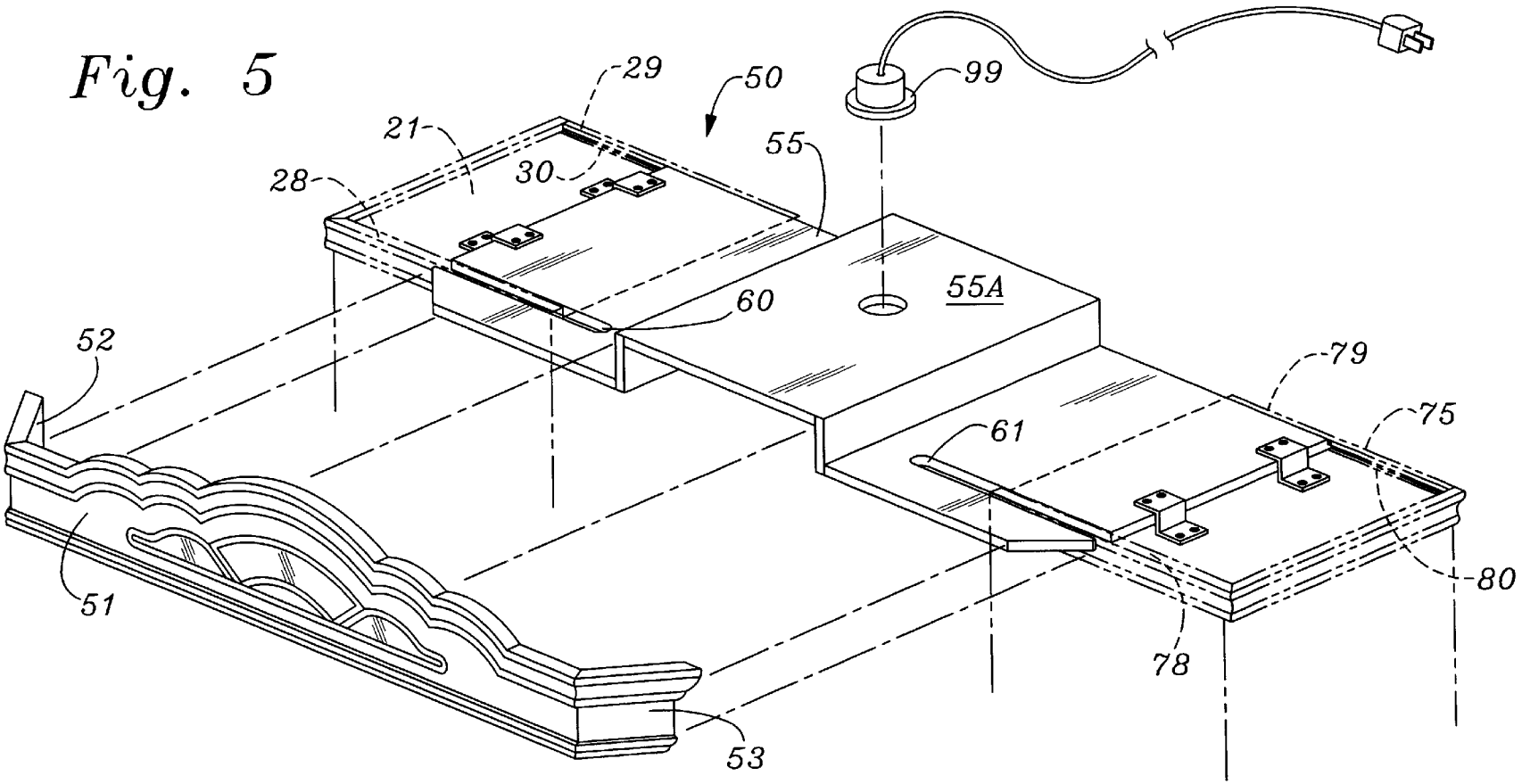
FIG. 5 is an exploded, perspective view of the bridge portion of the system of the instant invention with portions of the respective upright piers.

In addition, the retainer plates 37 and 87 are shown in FIG. 5. These retainers are, typically, thin plates of metal, wood, plastic or the like which retain and support the support plate 55 on the top edges of upper ends 28 and 78 of the trim of the piers 25 and 75 when the slots 60 and 61 pass completely through the plate 55.

Referring now to FIG. 5, there is shown a partially exploded, partially broken away oblique view of the bridge 50 and portions of the piers 25 and 75 (shown in dashed outline).

The bridge 50 includes the support plate 55 with the slots 60 and 61 therein. These slots slidably engage the upper front tops or upper ends 28 and 78 of the piers 25 and 75, respectively. The rear tops or upper ends 29 and 79 of the piers 25 and 75, respectively, include the slots 30 and 80 which slidably receive the ends of the plate 55.

As shown, the support plate 55 includes raised portion 55A which supports the optional light fixture 99. In addition, the raised portion 55A adds additional support and bracing for the decorative front face 51 of the movable bridge.

The decorative returns 52 and 53 are, typically, angulated relative to the decorative front face 51. The returns are formed contiguously and integrally with the front face to produce a unitary component. The free ends of the returns 52 and 53 are formed to precisely engage the trim at the upper ends 28 and 78 of the piers whereby the front decorative face of the bridge (face 51 together with returns 52 and 53) appears to be contiguous and integral with the trim elements 28 and 78 of the respective piers. Thus, the bridge 50 and the piers 25 and 75 give the appearance of a single, contiguous unit irrespective of the spacing between the piers 25 and 75. As a result, the single movable unit can provide multiple decorative concepts and appearance. For example, the piers can be side-by-side, the piers can be separated to receive a small TV and stand; or the piers can be separated sufficiently to receive a large screen TV therebetween. A single furniture unit provides multiple decorative possibilities.

Figure 6:
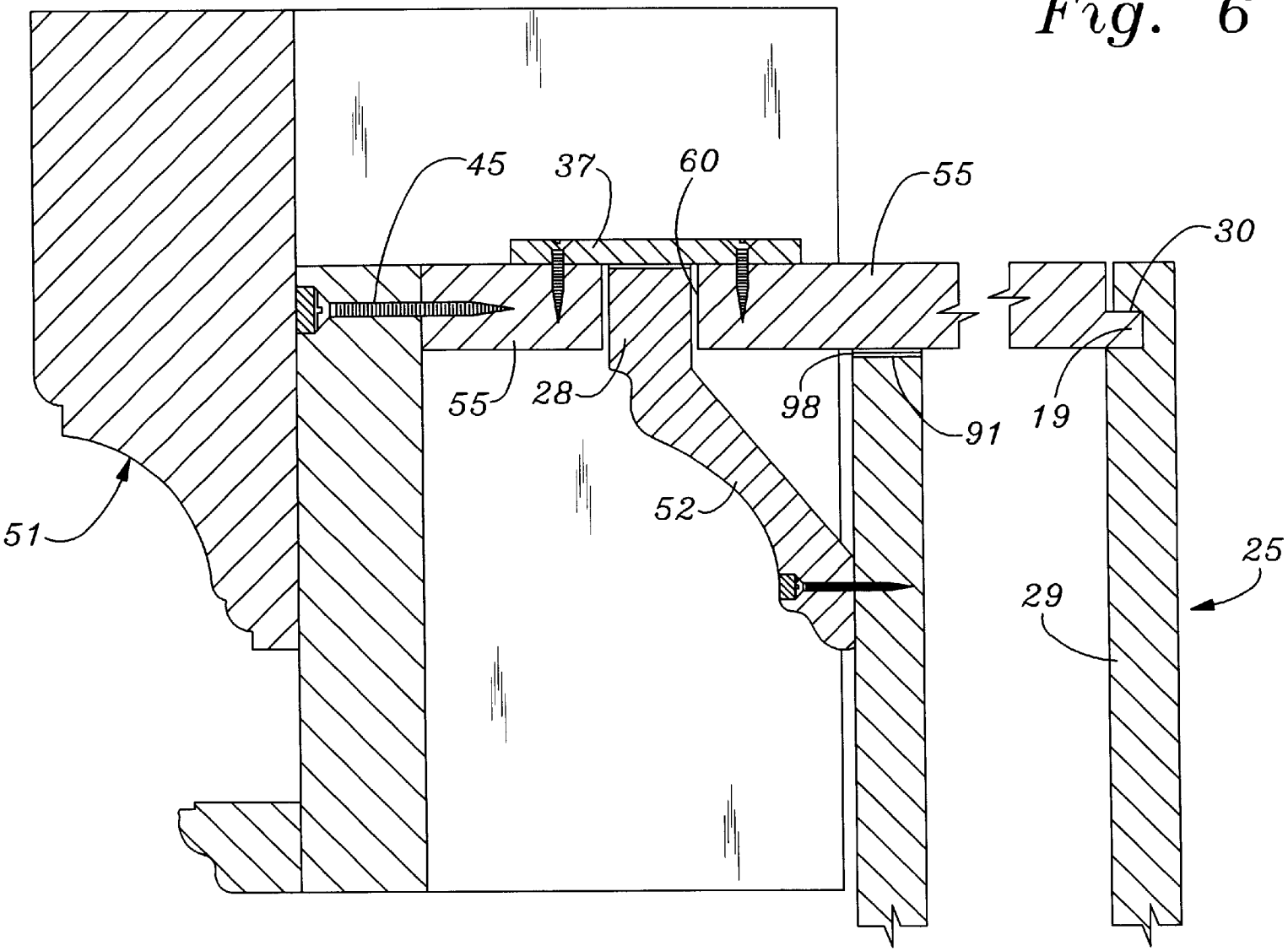
FIG. 6 is an enlarged, cross-sectional view of the interlocking portions of the system as taken along the lines 6—6 in FIG. 2.

Referring now to FIG. 6, there is shown a cross-sectional view of the interacting parts of the pier 25 and the bridge 50. This cross-sectional view is taken along the lines 6—6 in FIG. 2. The fascia 51 of the bridge 50 is attached to the support 55 by suitable means such as screws 45 or the like.

The support 55 rests on the upper edge surface 91 of the pier 25 and slides thereon. For convenience, a suitable slider layer 98 of plastic or the like may be deposited in suitable fashion on the surface 91. The upper edge of trim 28 fits, slidably into slot 60 in the support 55. The retainer 37 is shown affixed to support 55 and traversing slot 60. Again, a suitable slider mechanism can be utilized between the surfaces, if so desired. The rear edge of support 55 is shown in a slidably, interlocking relationship with the rear surface of the pier 25. That is, a suitable slot 30 is formed on the inner surface of the rear portion 29 of pier 25 to receive at least a portion 19 of the edge of support 55 so that the support can slide relative to the pier without becoming disengaged therefrom.

Thus, there is shown and described a unique design and concept of adjustable pier wall system. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A furniture unit comprising, first and second furniture components with decorative trim, and a unitary bridge slidably joined to the upper ends of each of said first and second furniture components and including decorative trim consistent with and slidably conforming to the decorative trim of said first and second furniture components, said unitary bridge includes a support plate having at least one slot therein for engaging a portion of at least one of said first and second furniture components, at least one of said first and second furniture components includes a slot in a rear portion thereof for slidably engaging said unitary bridge.

2. The unit recited in claim 1 wherein, said bridge includes a support plate having at least one slot therein for engaging a portion of at least one of said first and second furniture components.

3. The unit recited in claim 1 wherein, said bridge comprises at least two different levels.

4. The unit recited in claim 1 wherein, said bridge includes a light fixture mounted thereto.

5. The unit recited in claim 1 wherein, said bridge includes a support plate having at least two slots therein for engaging a portion of at least one of said first and second furniture components.

6. The unit recited in claim 1 including, a securing device attached to at least one of said first and second furniture components and said bridge.

7. The unit recited in claim 1 wherein, each of said first and second furniture components comprises an upright furniture pier.

8. The unit recited in claim 7 wherein each of said first and second furniture components includes at least one horizontal shelf therein.

9. The unit recited in claim 1 wherein, said first and second furniture components can be slidably adjusted relative to said unitary bridge so that said first and second furniture components are spaced apart at a predetermined distance.

10. The unit recited in claim 1 wherein said first and second furniture components can be sildably adjusted relative to said unitary bridge so that said first and second furniture components are in side-by-side relationship.

11. The unit recited in claim 1 wherein, said bridge includes a support plate having at least two slots therein for engaging a respective portion of each of said first and second furniture components.

12. The unit recited in claim 11 wherein, the length of each of said at least two slots is determinative of the distance which said first and second furniture components move relative to said unitary bridge.

13. The unit recited in claim 1 wherein, said unitary bridge includes at least a portion thereof which protrudes beyond the front of said first and second furniture components.

14. A furniture unit comprising, first and second furniture components with decorative trim, a bridge slidably joined to each of said first and second furniture and including decorative trim consistent with and slidably conforming with the decorative trim of said first and second furniture components, said bridge includes a support plate having at least one slot therein for engaging a portion of at least one of said first and second furniture components, and a retainer attached to said support plate traversing said slot therein.

15. The unit recited in claim 14 wherein, said at least one slot extends through said support plate.

16. A furniture unit comprising, first and second furniture components with decorative trim, and a bridge slidably joined to each of said first and second furniture components and including decorative trim consistent with the decorative trim of said first and second furniture components, at least one of said first and second furniture components includes a slot in a rear portion thereof for slidably engaging said bridge.

* * * * *